United States Patent [19]

Koch

[11] Patent Number: 4,719,533

[45] Date of Patent: Jan. 12, 1988

[54] DEVICE FOR TREATING SURFACES OF OBJECTS

[75] Inventor: Artur Koch, Schwalmtal-Brauerschwend, Fed. Rep. of Germany

[73] Assignee: Ahlbrandt Systems GmbH, Lauterbach, Fed. Rep. of Germany

[21] Appl. No.: 944,078

[22] Filed: Dec. 22, 1986

[30] Foreign Application Priority Data

Sep. 11, 1986 [DE] Fed. Rep. of Germany ..... 3603406

[51] Int. Cl.[4] ..... H01T 23/00

[52] U.S. Cl. ..... 361/230; 361/229

[58] Field of Search ..... 361/213, 214, 225, 226, 361/230, 229, 233, 222; 422/186.07, 186.12, 186.16, 186.18, 186.14; 315/170, 172–174

[56] References Cited

U.S. PATENT DOCUMENTS 4,385,261 5/1983 Kogelschatz et al. ..... 422/186.12 X

FOREIGN PATENT DOCUMENTS 1238653 4/1967 Fed. Rep. of Germany .
2550810 5/1977 Fed. Rep. of Germany .
201574 10/1924 United Kingdom ..... 361/226

*Primary Examiner*—L. T. Hix
*Assistant Examiner*—D. Rutledge
*Attorney, Agent, or Firm*—Quarles & Brady

[57] ABSTRACT

A device for treating surfaces of objects by means of corona discharge has an electrically insulated discharge electrode in an external tube. The external tube is electrically conductive and grounded. Part of the discharge electrode projects somewhat out of the external tube to define an active, or discharging, region. Between the external tube and the discharge electrode, and air gap exists through which air can be suctioned off during operation.

4 Claims, 2 Drawing Figures

DEVICE FOR TREATING SURFACES OF OBJECTS

BACKGROUND OF THE INVENTION

The field of the invention is devices for treating surfaces of objects by means of electrical corona discharge. Such devices are particularly designed for treating foils which are commonly known and used.

Corona discharge treatment usually serves to roughen a surface thereby increasing the ability of that surface to become wet and adhere. This type of surface treatment has a broad range of application in the area of the production of photographic paper. With paper or foil, the discharge electrode can be arranged in a fixed manner and the paper or foil can be guided over a grounded roller which is positioned opposite to the discharge electrode. Treatment which uses discharge electrodes is more difficult if the surfaces to be treated are three dimensional. In the automobile industry, for example, panels have been glued onto automobile body flanges for quite some time. Since the body must be enameled before gluing the panels, the automobile body flanges are also enameled. This leads to adhesion difficulties for the glue. Previously, material which enhanced adhesion was sprayed on. This, however, is inconvenient and leads to soiling of the area surrounding the body flange. Treatment of the body flange by corona discharge has until now not been undertaken because of the complex shape of the body.

SUMMARY OF THE INVENTION

The invention has the basic task of developing a device for treating surfaces by means of corona discharge, the discharge electrode of which can be easily guided along any desired contours, especially three dimensional contours, by hand or by means of a robot.

This task is solved according to the invention in that the discharge electrode is arranged in a freely movable external tube which is electrically conductive and connected to ground, and out of which a short discharge region projects.

One such discharge electrode can have its discharging end guided by hand, like a pencil, along the surface to be treated. An example of such a hand movement could be along a body flange of a motorized vehicle. As a result of this, one can also follow complex, three dimensional contours. Because the discharging electrode is surrounded by a grounded, electrically conductive external tube, it can be grasped while the device is operational, since the majority of the electrical energy flows toward the treated object through the corona and bypasses the external tube. Even when the discharge electrode does not discharge onto a treated object, it can still be grasped. A discharge electrode which has voltage applied between it and the grounded external tube still exhibits a shunt corona which dissipates essentially all of the energy. The device according to the invention is also suited for applying corona discharge treatment to a foil on a test basis using hand guided application in order to concomitantly examine the efficacy of this treatment.

A particularly simply constructed embodied example of the invention is evident in the case where the discharge electrode consists of a tube formed of quartz or a similar insulating material. The discharge electrode is closed at the discharging end and filled with aluminum granulate or a similar material for developing the discharge region. An insulated high-frequency ignition cable is led from the open end of the discharge electrode and projects into the aluminum granulate with a non-insulated end.

An especially advantageous embodied form of the invention results if an external tube is maintained at a distance from the tube forming the discharge electrode over its entire length by means of a range spacer and the air gap between the discharge electrode and the external tube is connected to an air suction source on the side opposite the discharging region. As a result of this design, ozone is extracted from the area in which the corona discharge is taking place, so that no damage to the health of the user or other persons located in the room can occur. Simultaneously, the discharge electrode and the external tube are cooled by the air stream which flows along the discharge electrode, permitting high voltages and preventing the external tube from becoming so hot that it can no longer be grasped.

Another design for the invention includes an intermediary tube composed of electrically conductive material and positioned inside of, and in electrical contact with, the external tube in the region of the granulate filling of the discharge electrode. The intermediary tube has less clearance to the discharge electrode than the external tube and is connected to ground through the external tube. The air gap between the discharge region of the discharge electrode and the intermediary tube is so small that in this region there is a corona discharge even when the discharge electrode is not located close to a grounded object. Because of this, the generator which supplies the device with electrical energy does not need to shut off when the discharge treatment of an object is interrupted, but rather operates steadily with a permanent load. As a result, the construction of the generator is simplified. This measure allows the active part of the discharge electrode to be contacted by the hand even when high voltage is applied to the device. Since the electrical resistance of the human body is much higher than that of the air gap between the discharge electrode and the intermediary tube, such a small quantity of energy flows over the human body that it does not create an uncomfortable feeling or a damaging situation. Since the air gap is relatively narrow only in the region of the intermediary tube, the air after passing this point can expand, so that the current consumption in total is small.

For treating smaller areas, for example the body flange of a motor vehicle, it is advantageous if the discharge end of the corona electrode which projects from the external tube is closed off by a hemispherical closure. Of course, this closure of the discharge electrode can be designed for various instances of applications.

The invention accommodates numerous embodiments. One of these is represented in the illustration and is described in the following.

DESCRIPTION OF THE PREFERRED EMBODIMENT

Figure 1:
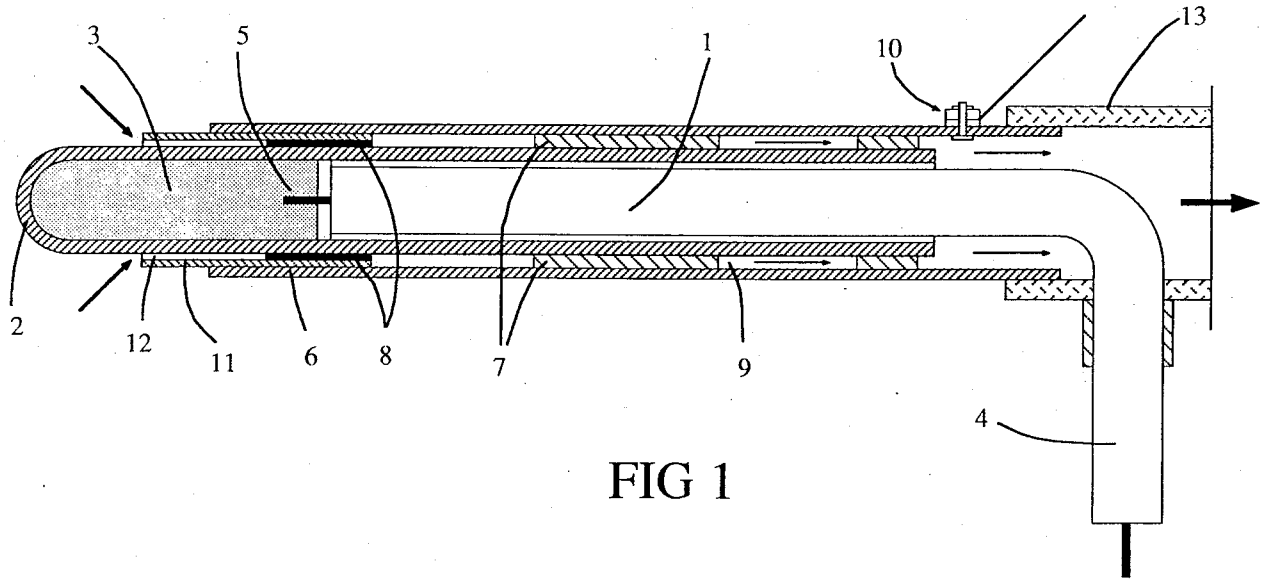
FIG. 1 is a longitudinal section of a device according to the invention.

FIG. 1 shows a discharge electrode 1 using a quartz tube which is closed off on the left side by a hemispherical closure 2, similar to a test tube. On the closed side of the discharge electrode 1, an active region is formed by means of filling with aluminum granulate 3. An electrically insulated high frequency ignition cable 4 is led into the open end of the discharge electrode 1 and projects into the aluminum granulate 3 with a non-insulated end 5.

An external tube 6 composed of electrically conductive material is arranged coaxial to the discharge electrode 1, the external tube being maintained at a fixed distance from the discharge electrode 1 by range spacers 7 and 8. The range spacers 7 and 8 are strips composed of insulating material, so that between the discharge electrode 1 and the external tube 6 an air gap 9 exists. The external tube 6 has a connection 10, so that it can be connected to ground.

In the active region of the discharge electrode 1, an intermediary tube 11 composed of conductive material is emplaced in the external tube 6. The intermediary tube 11 forms an air gap 12 between itself and the discharge electrode 1. The width of the air gap 12, however, is smaller than the clearance between the external tube 6 and the discharge electrode 1.

An air suction nozzle 13 is placed on the open end of the external tube 6. The nozzle 13 is connected with an air suctioning source (not shown). Air can thereby be suctioned through the air gaps 12 and 9, as a result of which the discharge electrode 1 is cooled and ozone resulting from the operation is suctioned away.

With high voltage applied, if the rounded closure 2 of the discharge electrode 1 is positioned opposite a surface which is to be treated, then the desired corona discharge occurs. If the closure 2 is held at a greater distance from a grounded surface, then a corona discharge occurs only between the part of the discharge electrode 1 which is active as a result of the aluminum granulate 3 and the grounded intermediary tube 11, so that the generator can continue to operate with a basic load.

Figure 2:
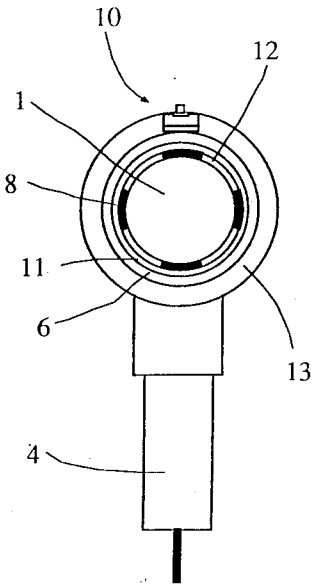
FIG. 2 is a front view of the device of FIG. 1.

Referring to FIG. 2, it can be seen that strip-shaped construction components serve as range spacers 8 between which air can flow to the air suction nozzle 13.

The table below is a listing of references used in the drawings:

| |
|---|
| 1. discharge electrode |
| 2. closure |
| 3. aluminum granulate |
| 4. high frequency ignition cable |
| 5. non-insulated end |
| 6. external tube |
| 7. range spacer |
| 8. range spacer |
| 9. air gap |
| 10. ground connection |
| 11. intermediary tube |
| 12. air gap |
| 13. air suction nozzle |

What is claimed is:

1. A device for treating surfaces of objects by means of electrical corona discharge, comprising:

an external tube formed from an electrically conductive material and connected to a voltage source of ground potential;

a discharge electrode positioned in the external tube out of which a short discharge region projects, the discharge electrode including:

a discharge tube composed of an insulating material, the discharge tube being closed on one end;

a conductive material disposed in the closed end of the discharge tube to define the discharge region; and a high frequency ignition cable disposed inside the discharge tube and having a non-insulated end projecting into the conductive material.

2. The device of claim 1 in which the external tube is maintained at a distance from the discharge electrode along the entire length of the external tube by at least one range spacer, thereby defining an air gap between the discharge electrode and the external tube and in which the end of the external tube opposite the discharge region is connected to an air suction source.

3. The device of claims 1 or 2 which includes an intermediary tube formed of conductive material and positioned inside the external tube near the discharge region, with the outside of the intermediary tube touching the external tube in electrical contact, the intermediary tube thereby being grounded and having less clearance to the discharge electrode than the external tube.

4. The device of claims 1 or 2 in which the closed end of the discharge electrode tube is closed off by means of a hemispherical closure.

* * * * *